US005897804A

United States Patent [19]

Hall

[11] Patent Number: 5,897,804

[45] Date of Patent: Apr. 27, 1999

[54] METHOD AND MEANS OF HEATING AND CONTROLLING THE TEMPERATURES IN A SAUNA

[75] Inventor: Keith A. Hall, Bettendorf, Iowa

[73] Assignee: Quad Cities Automatic Pools, Inc., Bettendorf, Iowa

[21] Appl. No.: 08/950,648

[22] Filed: Oct. 15, 1997

[51] Int. Cl.[6] ..... H05B 1/02

[52] U.S. Cl. ..... 219/501; 219/519; 219/483; 4/524

[58] Field of Search ..... 219/483–486, 219/411–413, 501, 494, 497, 506, 509; 4/524–531; 307/38–41

[56] References Cited

U.S. PATENT DOCUMENTS

| | | | |
|---|---|---|---|
| 3,858,141 | 12/1974 | Lackey | 337/140 |
| 3,892,946 | 7/1975 | Rimmi | 219/486 |
| 4,238,672 | 12/1980 | Siess | 219/502 |
| 4,243,875 | 1/1981 | Chang | 219/497 |
| 4,908,498 | 3/1990 | Kivela | 219/494 |
| 4,959,527 | 9/1990 | Kivimaa et al. | 219/365 |
| 5,077,461 | 12/1991 | Hasegawa | 219/553 |
| 5,416,931 | 5/1995 | Wolfenden et al. | 4/524 |

*Primary Examiner*—Mark Paschall
*Attorney, Agent, or Firm*—Zarley, Mckee, Thomte, Voorhees & Sease

[57] ABSTRACT

A control circuit for a sauna compartment has an electrical heater therein connected to a control circuit. The control circuit allows a high voltage to flow through a first heating circuit to permit ambient air in the compartment to reach a first high temperature, at which time voltage is provided to the heater only through the second heating circuit and thence to the heater so that the ambient air in the compartment will maintain said first high temperature to prevent a person in the sauna compartment from feeling immediately chilled when the first high temperature is reached and voltage through the first heating circuit ceases to move to the heater. The method of heating a sauna compartment and controlling the temperature therein involves placing an electrical heater in a sauna compartment; connecting the heater to a source of electrical energy; connecting a control circuit to the heater including first and second heating circuits with each circuit adapted to provide first and second voltages to the heater; sequentially allowing a high voltage to flow through the first heating circuit to permit the ambient air in the compartment to reach a first high temperature, at which time a voltage is provided to the heater only through the second heating current and thence to the heater so that the ambient air in the compartment will maintain said first high temperature to prevent a person in the sauna compartment from feeling immediately chilled when the first high temperature is reached and voltage through the first heating circuit ceases to move to the heater.

9 Claims, 1 Drawing Sheet

METHOD AND MEANS OF HEATING AND CONTROLLING THE TEMPERATURES IN A SAUNA

BACKGROUND OF THE INVENTION

Modern sauna compartments are often heated by an infrared heater which is controlled by a thermostat. The thermostat will be set at a maximum temperature such as 120° F. When that temperature is reached, the thermostat interrupts the flow of energy to the heater which is de-energized. A person in the sauna immediately feels chilled when the infrared is completely turned off at the 120° F. maximum temperature level.

Therefore, a principal object of this invention is to provide a method and means for heating a sauna compartment and controlling that heat so that when a maximum temperature is reached, the energy flowing to the heater will be decreased rather than being discontinued completely whereupon the normal chilling effect described heretofore will be eliminated.

A further object of this invention is to maintain the temperature in a sauna compartment at a high comfort level to a person therein and to economize on the energy required to maintain such temperature levels.

These and other objects will be apparent to those skilled in the art.

SUMMARY OF THE INVENTION

A control circuit for a sauna compartment has an electrical heater therein connected to a control circuit. The control circuit allows a high voltage to flow through a first heating circuit to permit ambient air in the compartment to reach a first high temperature, at which time voltage is provided to the heater only through the second heating circuit and thence to the heater so that the ambient air in the compartment maintains the high temperature to prevent a person in the sauna compartment from feeling immediately chilled when the first high temperature is reached and voltage through the first heating circuit ceases to move to the heater.

The method of heating a sauna compartment and controlling the temperature therein involves placing an electrical heater in a sauna compartment; connecting the heater to a source of electrical energy; connecting a control circuit to the heater including first and second heating circuits with each circuit adapted to provide first and second voltages to the heater; sequentially allowing a high voltage to flow through the first heating circuit to permit the ambient air in the compartment to reach a first high temperature, at which time a voltage is provided to the heater only through the second heating current and thence to the heater so that the ambient air temperature in the compartment will be maintained to prevent a person in the sauna compartment from feeling immediately chilled when the first high temperature is reached and voltage through the first heating circuit ceases to move to the heater.

DESCRIPTION OF THE PREFERRED EMBODIMENT

Figure 1:
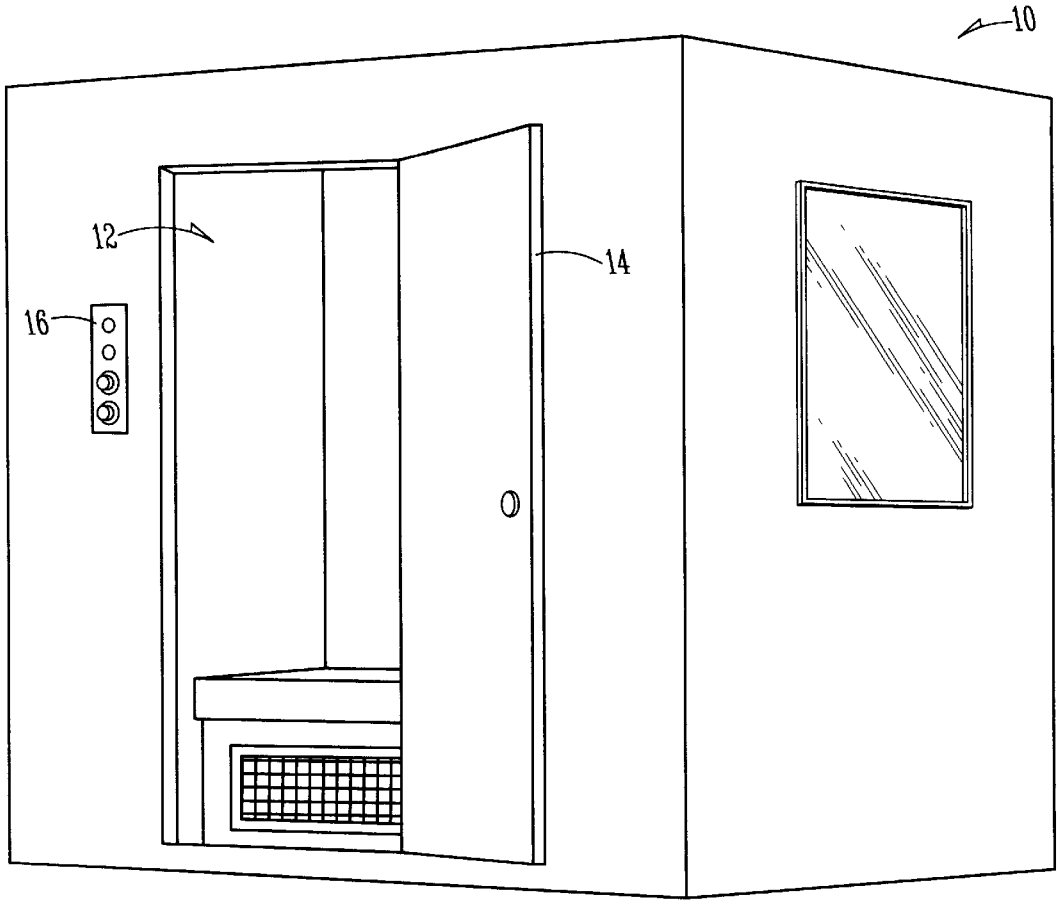
FIG. 1 is a perspectively view of a conventional sauna compartment or bath.

A sauna compartment 10 has a door opening 12 and a conventional door 15 adapted to close the opening 12. A control panel 16 can be mounted in the wall of compartment 10 adjacent the door as shown in FIG. 1.

Figure 2:
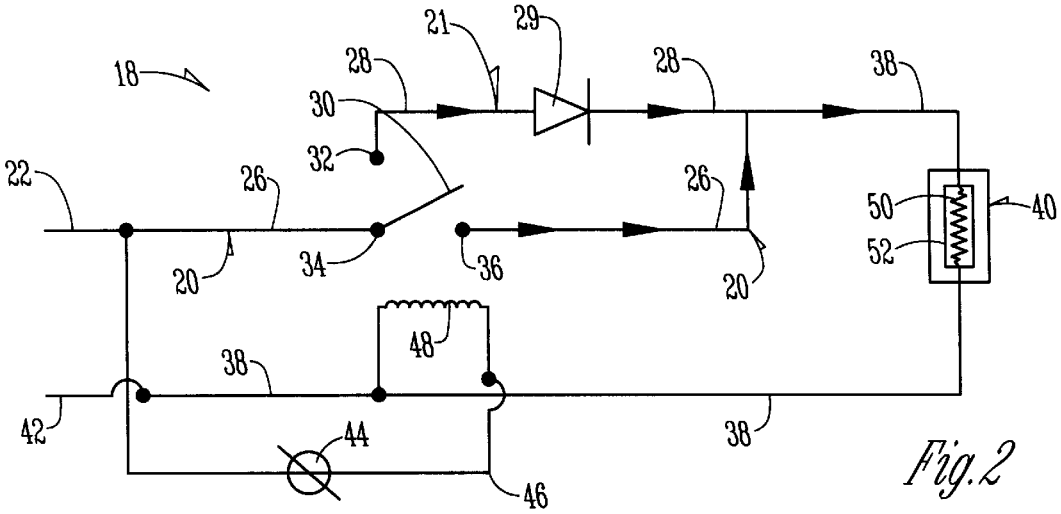
FIG. 2 is a schematic wiring diagram showing the control circuitry for heating the sauna compartment.

With reference to FIG. 2, a control circuit 18 has a first heating circuit 20 and a second heating circuit 21. First heating circuit 20 is connected to a 120 volt source. A double relay switch 24 is imposed in lines 26 and 28 and includes a diode 29 that is imposed in line 28.

The switch arm 30 of the double relay switch 24 is disposed in line 26 between terminals 32 and 34 when voltage is passing through heating circuit 20. Alternatively, the switch arm 30 is disposed between terminals 34 and 38 when the first heating circuit 20 is open and the second heating circuit 21 is closed.

A line 38 connects line 28 with infrared heater 40. Line 38 then extends to a conventional ground 42. Thus, when the heating circuit 20 is operational, voltage flows through line 26, switch arm 30, terminal 36 and thence continuing through line 26 until line 38 is encountered. The voltage then flows through heater 40 and returns to ground 46.

When switch arm 30 is moved into contact with terminal 38, the first heating circuit 20 is interrupted and the secondary heating circuit 21 is activated whereupon voltage flows from voltage source 22 through line 26 to terminal 34, thence through switch arm 30 and terminal 38, and thence through line 28, and line 38 to heater 40. The presence of the diode 29 in the secondary circuit 21 decreases the voltage between the diode and the heater whereupon less heat is generated. Typically, the initial heating circuit 20 pulls approximately 13 amps, while the secondary heating circuit 21 pulls about 7 amps. The line 38 is the terminal line for both circuits 20 and 21.

A thermostat 44 is imposed in line 45. Line 46 extends from line 26 adjacent voltage source 22 and terminates in connection with line 38. A relay coil 48 is imposed in line 46.

In practice, when the control circuit 18 is turned on at control panel 16, the thermostat, which typically would be set at 120° F. permits voltage to flow through line 46 through coil 48 and thence back to ground 42. The coil 48 energizes the switch arm 30 to move into contact with terminal 36 whereby the heating circuit 21 is made inoperative and the heating circuit 20 is made operative. Approximately 13 amps passes through circuit 20 and heater 40 is in its maximum heating mode.

When the thermostat detects a temperature of approximately 120° F., it opens in conventional manner breaking the flow of voltage through coil 48. Spring loaded switch arm 80 (the spring mechanism of the conventional apparatus has not been shown) moves into contact with terminal 38 whereupon heating circuit 20 is broken and heating circuit 21 is activated. By reason of the diode 29 in line 28, the voltage flowing to heater 40 in circuit 21 is less than the voltage flowing to the heater through circuit 20 when it was operative. Typically, the heater 40 would draw approximately 7 amps while the heating circuit 21 was operative.

Thus, it is seen that the heating circuit will never be totally interrupted for when heating circuit 20 is interrupted at the higher temperature of 120° F., the secondary heating circuit 21 immediately cuts in and maintains a 120° F. temperature in the compartment 10. If the temperature falls, thermostat 44 cuts in and reestablishes circuit 20, and opens circuit 21. This happens when coil 48 is re-energized to move arm 34 back to terminal 36.

As seen in FIG. 2, the heating rod 50 can be encapsulated in ceramic material 52 whereby the ceramic material will provide residual heat to the compartment.

More specifically, with the use of the double throw relay 22, and when the temperature in the sauna reaches the level set on the thermostat 44, the relay coil 48 will open. However, instead of there being a complete shut down of the heater 40, the relay coil 48 will connect the double throw relay in the manner described above to make the secondary heating circuit 21. The double throw relay 22 creates an alternative path of voltage flow to heater 40 via circuit 20 or circuit 26. The path of circuit 2 which includes diode 22 significantly decreases the voltage to the heater 40 thus allowing the heater to produce less heat without shutting down the system all together. Thus, the sudden decrease of temperature in the sauna is avoided. The circuit 21 will continue to function until the ambient temperature reaches 119° F., whereupon circuit 20 will assume control as described above.

It is therefore seen that this invention will achieve at least all of its stated objectives.

What is claimed is:

1. A method of heating a sauna compartment or the like, comprising, placing an electrical infrared heater in a sauna compartment and connecting said heater to a source of electrical energy, connecting a control circuit to said heater including first and second heating circuits with each circuit adapted to provide first and second voltages to said heater, and sequentially allowing a high voltage to flow through said first heating circuit to permit the ambient air in said compartment to reach a first high temperature, at which time a lower voltage is provided to said heater only through said second heating circuit to said heater so that the ambient air in said compartment will be substantially maintained at said high temperature to prevent a person in the compartment from feeling immediately chilled when said first high temperature is reached and voltage through said first heating circuit ceases to move to said heater.

2. The method of claim 1 wherein said infrared heater is comprised of an infrared element encapsulated in a heat sink material to provide residual heat to said compartment.

3. The method of claim 1 wherein said first high temperature is approximately 120° F.

4. The method of claim 1 wherein the amperage in said first and second heater circuits is approximately 13 and 7 amps, respectively, when each circuit is operative.

5. The method of claim 1 wherein said first heating circuit is re-energized if the temperature in said compartment drops below said first high temperature while said second heating circuit is energized.

6. The method of claim 1 wherein said first heating circuit is re-energized if the temperature in said compartment drops below said first high temperature while said second heating circuit is energized, and said second heating circuit is thereupon de-energized.

7. A control circuit for an electrical infrared heater in a sauna comprising an infrared heater:

a thermostat for sensing the temperature in the sauna;

a relay electrically connected to the thermostat and to a source of electrical power, the relay having first and second operating positions;

a first circuit electrically connected to infrared heater and to the relay such that a connection is made between the power source and the heater when the relay is in the first operating position;

a second circuit electrically connected to heater and to the relay such that the power source and the heater are electrically connected through the second circuit when the relay is in the second operating position, wherein the second circuit includes a device for reducing power supplied to the heater through the second circuit; and wherein the thermostat causes the relay to be in the first operating position when the sensed temperature in the sauna is below a threshold temperature, and the thermostat causes the relay to be in the second operating position when the sensed temperature in the sauna is not below the threshold temperature.

8. The control circuit of claim 7, wherein the device is comprised of a diode.

9. The control circuit of claim 8, wherein the diode reduces the amount of current supplied to the heater.

* * * * *